US006856099B2

(12) United States Patent
Chen et al.

(10) Patent No.: US 6,856,099 B2
(45) Date of Patent: Feb. 15, 2005

(54) MULTI-LAMP ACTUATING FACILITY

(75) Inventors: Mender Chen, Taoyuan (TW); Woody Chan, Taipei (TW); Kevin Wang, Taipei Hsien (TW)

(73) Assignee: Taipei Multipower Electronics Co., Ltd., Taipei (TW)

( * ) Notice: Subject to any disclaimer, the term of this patent is extended or adjusted under 35 U.S.C. 154(b) by 0 days.

(21) Appl. No.: 10/621,996

(22) Filed: Jul. 16, 2003

(65) Prior Publication Data

US 2005/0012466 A1 Jan. 20, 2005

(51) Int. Cl.[7] ..... H05B 37/02
(52) U.S. Cl. ..... 315/224; 315/299; 315/308
(58) Field of Search ..... 315/209 R, 224–226, 315/291, 299–301, 307, DIG. 7, 293, 294, 308

(56) References Cited

U.S. PATENT DOCUMENTS 3,916,251 A * 10/1975 Hernandez et al. ..... 378/110
4,396,872 A * 8/1983 Nutter ..... 315/308
4,870,327 A * 9/1989 Jorgensen ..... 315/307
5,838,116 A * 11/1998 Katyl et al. ..... 315/307
2004/0032223 A1 * 2/2004 Henry ..... 315/291

* cited by examiner

*Primary Examiner*—Thuy Vinh Tran
(74) *Attorney, Agent, or Firm*—Charles E. Baxley

(57) ABSTRACT

A lamp actuating device includes a number of lamps each having an output terminal, an inverter circuit coupled to the lamps to convert electric power and to energize the lamps, a low frequency control unit coupled to the inverter circuit, to set an average current value at the output terminals of the lamps and to control the inverter circuit, a number of current detecting units coupled between the lamps and the low frequency control unit to obtain and send the average current value at the output terminals of the lamps to the low frequency control unit. A number of regulating devices are coupled between the lamps and the low frequency control unit respectively, to control electric power through the lamps, and to maintain each of the lamps at the average current value.

5 Claims, 6 Drawing Sheets

MULTI-LAMP ACTUATING FACILITY

BACKGROUND OF THE INVENTION

1. Field of the Invention

The presented invention relates to a light tube or lamp actuating facility, particularly to a lamp actuating facility for evenly or uniformly driving or actuating a number of light tubes or lamps such as liquid crystal display (LCD) light devices or display panels.

2. Description of the Prior Art

Typical LCD display panels employ various kinds of discharge lamps, such as cold cathode fluorescent lamps (CCFL) as the backlight source for the display panels, and employ an inverter circuit to drive the discharge lamps.

In larger LCD display panels, a number of lamps or light tubes are required to be provided and installed for providing the required brightness. When a number of lamps are installed in the larger LCD display panels, a single transformer or driving or actuating circuit is not so effective on performance to actuate or drive two or more discharge lamps that are coupled parallel with each other.

For example, the impedances of the discharge lamps may be different from each other, and may seriously influence the flowing of the electricity through the discharge lamps; i.e., the electricity may not be evenly flown through the discharge lamps, such that the discharge lamps may not be suitably driven or actuated or energized.

When the electric current is less than the required amount, the discharge lamps may not be suitably driven or actuated or energized to the required brightness, and the brightness in different portions or areas of the larger LCD display panels may be different from each other, and may seriously decrease the uniformity of the display panels.

On the contrary, when the electric current is greater than the predetermined amount, the discharge lamps may be over-energized and the working life of the discharge lamps may be greatly decreased. In addition, the characteristics of the discharge lamps may be changed any time, such that the electricity may not be used to evenly energize various discharge lamps.

For example, the diameters of different discharge lamps may be different from each other, the mercury densities and/or the electrodes of different discharge lamps may also be different from each other, the pressures of different discharge lamps may also be different from each other, such that the impedances of the discharge lamps may be different from each other, and such that different discharge lamps may not be evenly energized by the typical driving or actuating circuits.

Furthermore, when the discharge lamps are initialized, various kinds of strong interferences, noises, abrupt waves, may be generated, and may directly or indirectly affect the normal operation of peripheral facilities of the display panels. The higher voltage is applied, the higher electromagnetic interference may be generated, and thus may injure the users and the others.

In addition, the discharge lamps of the typical LCD display panels may normally generate flashes that people may not be easily conscious of and that may hurt people or may easily fatigue people or users.

The present invention has arisen to mitigate and/or obviate the afore-described disadvantages of the conventional lamp actuating facilities.

SUMMARY OF THE INVENTION

The primary objective of the present invention is to provide a lamp actuating facility for evenly and uniformly driving or actuating a number of light tubes or lamps of such as liquid crystal display (LCD) light devices or display panels.

In accordance with one aspect of the invention, a lamp actuating facility is provided, it comprises a plurality of lamps each including an output terminal, an inverter circuit coupled to the lamps, to convert electric power and to energize the lamps, a low frequency pulse width modulated mode (PWM) control unit coupled to the inverter circuit, to set an average current value at the output terminals of the lamps, and to control the inverter circuit, a plurality of current detecting units coupled between the lamps and the low frequency control unit respectively, to obtain the average current value at the output terminals of the lamps, and to send the average current value back to the low frequency control unit, and a plurality of regulating devices coupled between the lamps and the low frequency control unit respectively, to control electric power through the lamps, and to maintain each of the lamps at the average current value.

A MOSFET may further be provided and coupled between the inverter circuit and the low frequency control unit. The MOSFET includes a drain electrode coupled to the inverter circuit via an inductor, and a gate electrode and a source electrode grounded.

Each of the regulating devices includes a first transistor having a base coupled to the low frequency control unit, a collector coupled to electric power source, and an emitter grounded. Each of the regulating devices further includes a first resistor having two ends, a second resistor, a second transistor having a base coupled to the collector of the first transistor, and having a collector and an emitter coupled to the ends of the first resistor, and then grounded via the second resistor. The first resistor preferably includes a resistance greater than that of the second resistor.

Each of the current detecting units preferably includes an integrator coupled to the low frequency control unit.

Further objectives and advantages of the present invention will become apparent from a careful reading of the detailed description provided herein below, with appropriate reference to the accompanying drawings.

DETAILED DESCRIPTION OF THE PREFERRED EMBODIMENT

Figure 1:
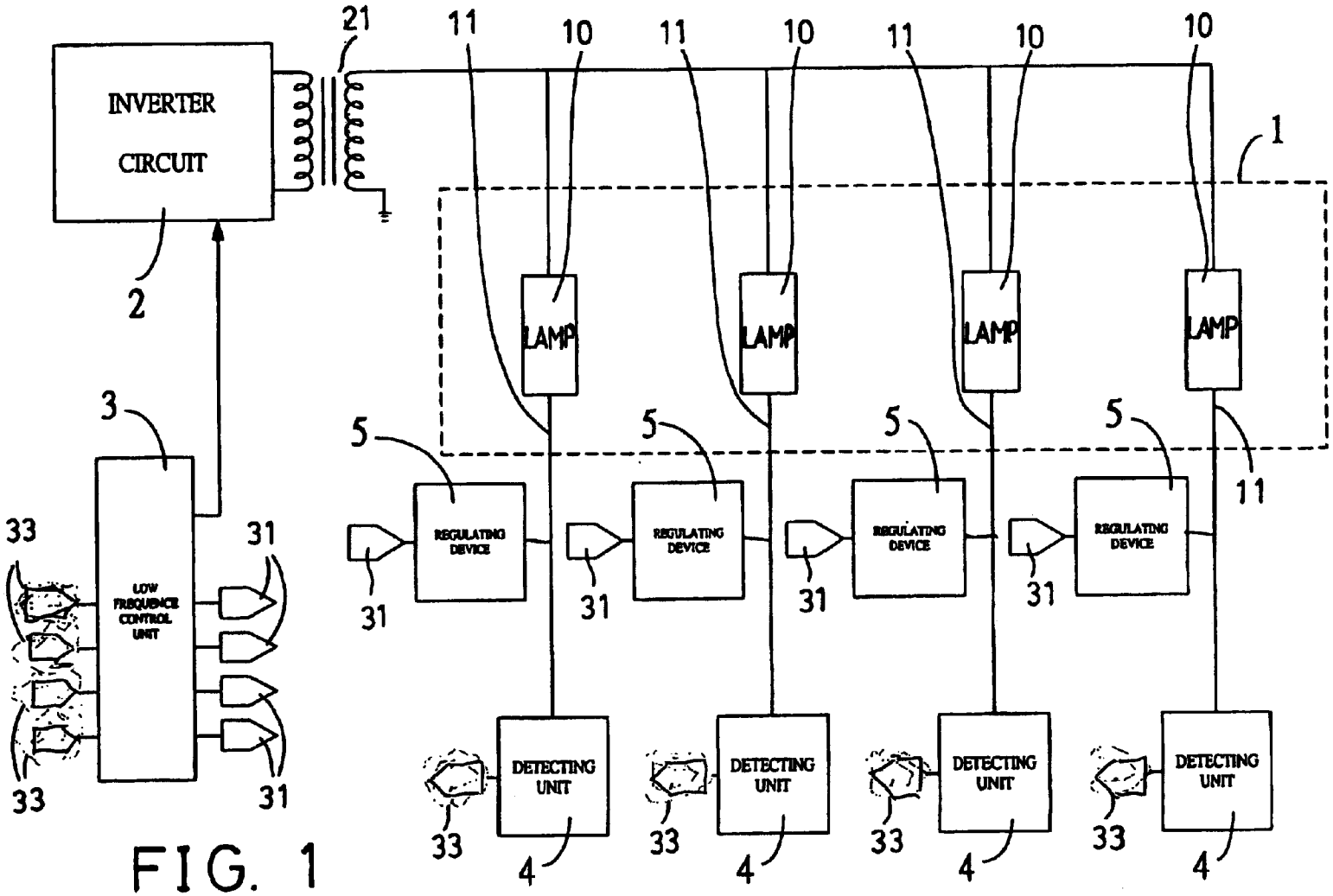
FIG. 1 is a block diagram of a lamp actuating facility in accordance with the present invention.

Referring to the drawings, and initially to FIG. 1, a lamp actuating facility in accordance with the present invention comprises a light device 1 including one or more lamps 10 coupled parallel to each other, and an inverter circuit 2 including a transformer 21 coupled to the lamps 10 of the light device 1, for converting direct current (DC) to alternate current (AC), in order to energize the lamps 10 of the light device 1.

A low frequency control unit 3 is coupled to the inverter circuit 2, for setting the average value of the effective current at the output terminals 11 of the lamps 10 of the light device 1, in order to control or actuate or drive the inverter circuit 2 to suitably provide the electricity to the lamps 10 of the light device 1 in predetermined period, and thus to suitably energize the lamps 10 of the light device 1.

One or more current detecting units 4 are coupled to the output terminals 11 of the lamps 10 of the light device 1, to detect or obtain the average value of the effective current at the output terminals 11 of the lamps 10 respectively, and to send the average value of the effective current at the lamps 10 to the low frequency control unit 3, in order to suitably control or actuate or drive the inverter circuit 2 to energize or actuate the lamps 10 of the light device 1.

One or more regulating devices 5 are also coupled to the output terminals 11 of the lamps 10 of the light device 1, to control the electricity or the electric current through the respective lamps 10, for allowing the electricity or the electric current through the respective lamps 10 to be maintained at the predetermined average value of the effective current.

In operation, the low frequency control unit 3 may be used to control the electric current at the output terminals 11 of the lamps 10 respectively by the transformer 21 of the inverter circuit 2, and to control the actuation time interval (duration) of the regulating devices 5 with low frequencies, in order to adjust or regulate or control the average value of the effective current of the lamps 10 at a same or identical value, for allowing the lamps 10 of the light device 1 to be evenly energized or actuated.

Figure 2:
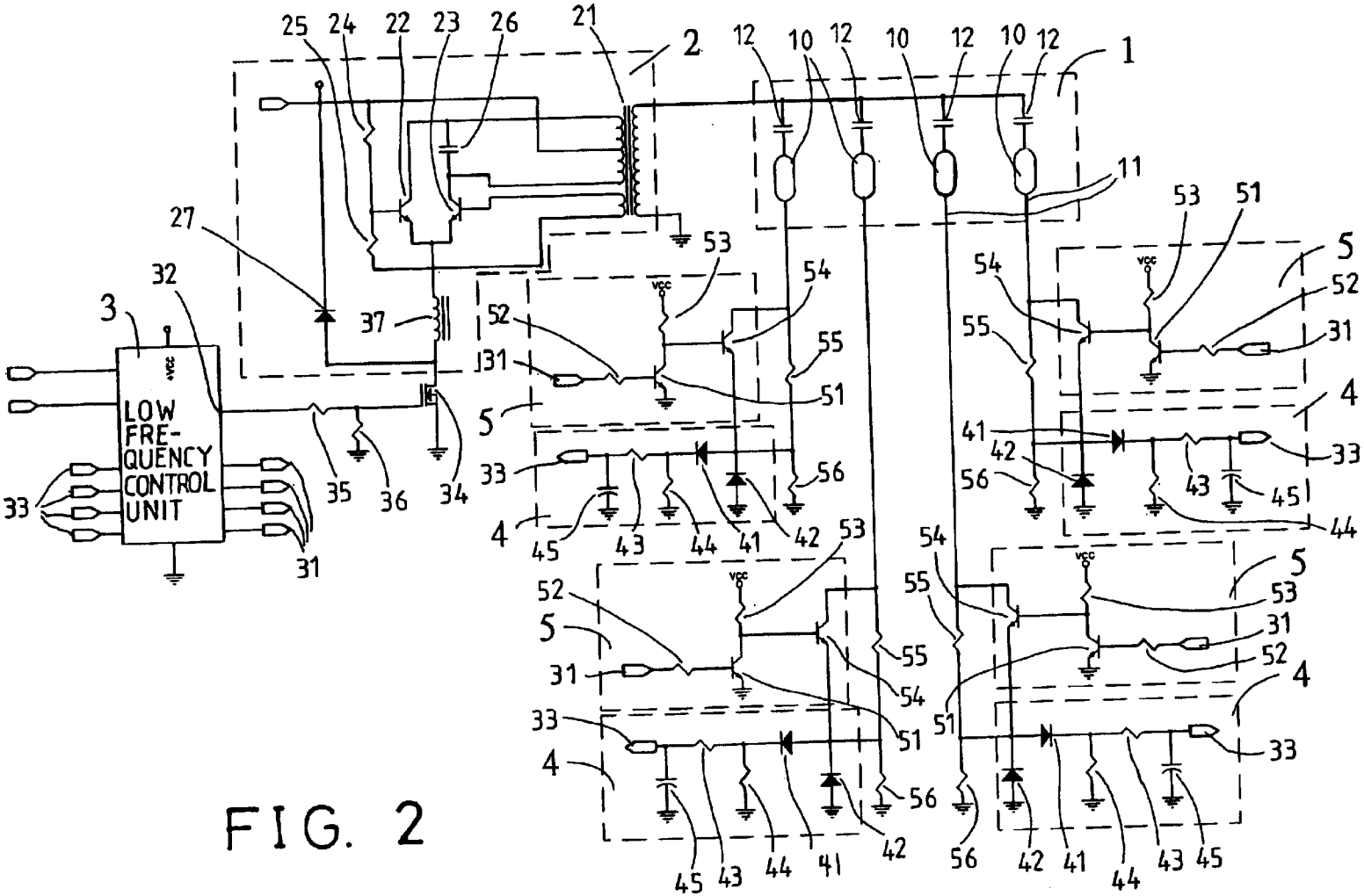
FIG. 2 is a plan schematic view illustrating an electric circuit of the lamp actuating facility.

Referring FIG. 2, the illustration showed an example of the electric circuit of the lamp actuating facility, which includes one or more capacitors 12 coupled between the lamps 10 and the transformer 21 of the inverter circuit 2. One set of a current detecting unit 4 and a regulating device 5 is coupled to each of the lamps 10, and controlled by the low frequency control unit 3.

Each of the regulating devices 5 includes a transistor 51 having a grounded emitter, a base coupled to a respective output or actuating terminal 31 of the low frequency control unit 3 via a resistor 52, and a collector coupled to an electric power source Vcc via another resistor 53; and includes another transistor 54 having a base coupled to the collector of the transistor 51, and having an emitter and a collector coupled to two ends of a respective resistor 55, and then grounded via a further resistor 56. It is preferable that the resistors 55 include a resistance or impedance greater than that of the other resistors 56.

Each of the current detecting units 4 includes two diodes 41, 42 coupled to the emitters of the transistors 54 respectively in different directions, and coupled to input terminals 33 of the low frequency control unit 3 via a resistor 43, and another resistor 44 and a capacitor 45 coupled to two ends of the resistor 43 respectively, and to form an integrator.

The low frequency control unit 3 includes a control signal output terminal 32 coupled to a gate electrode of a metal oxide semiconductor type field effect transistor (MOSFET) 34 via a resistor 35, and another resistor 36 coupled between the resistor 35 and the gate electrode of the MOSFET 34. The MOSFET 34 includes a drain electrode coupled to the inverter circuit 2 via an inductor 37, and a source electrode grounded.

The inverter circuit 2 may be various transforming or converting circuits for converting DC current to AC current and to energize the lamps 10 of the light device 1. For example, the inverter circuit 2 includes two transistors 22, 23, two resistors 24, 25, and a capacitor 26 coupled together to form a push-pull type resonant circuit, in order to generate oscillations or the like, and to energize the lamps 10 of the light device I via the transformer 21 which may increase the voltage of the inverter circuit 2.

The inverter circuit 2 may further include a diode 27 coupled in parallel to the inductor 37. The inductor 37 and the diode 27 and the MOSFET 34 may form a stabilizer or a current feed buck type regulator for stabilizing the electric power source, and for the soft start acting during the ignition period of lamps actuating.

Figure 3:
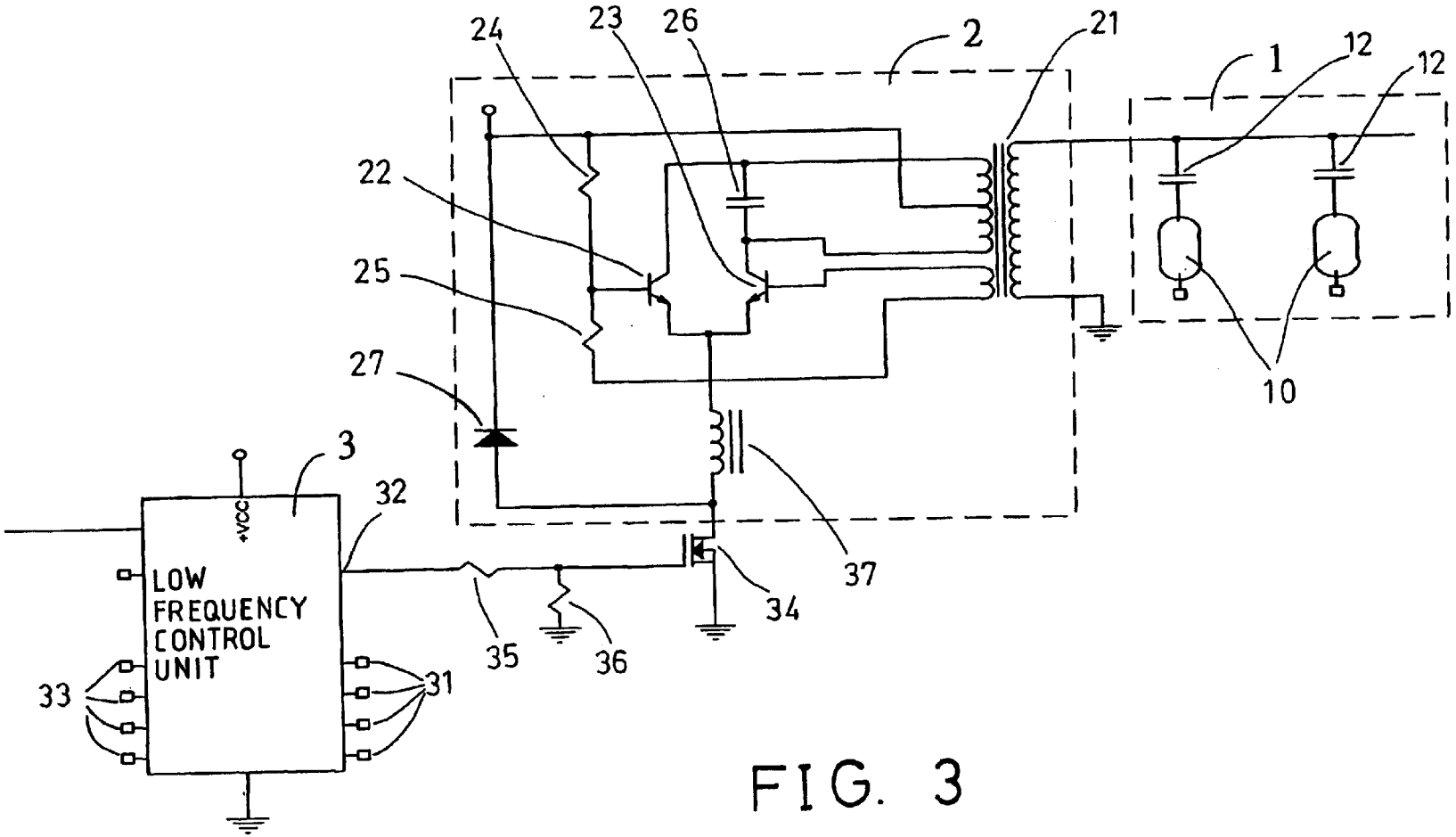
FIG. 3 is a partial plan schematic view illustrating the pre-regulation and soft start control of the inverter circuit by the low frequency control device.

In operation, as shown in FIG. 3, when the lamp actuating facility is energized (Vcc), the duty or actuation period and the frequency of the MOSFET 34 may be controlled to gradually change or increase or decrease the output voltage from the MOSFET 34, in order to gradually energize every lamp 10 of the light device 1 to the predetermined average value of the effective current, via the low frequency control unit 3 and the regulating devices 5, and to prevent the lamps 10 from being suddenly energized and from generating electromagnetic interferences.

Figure 4:
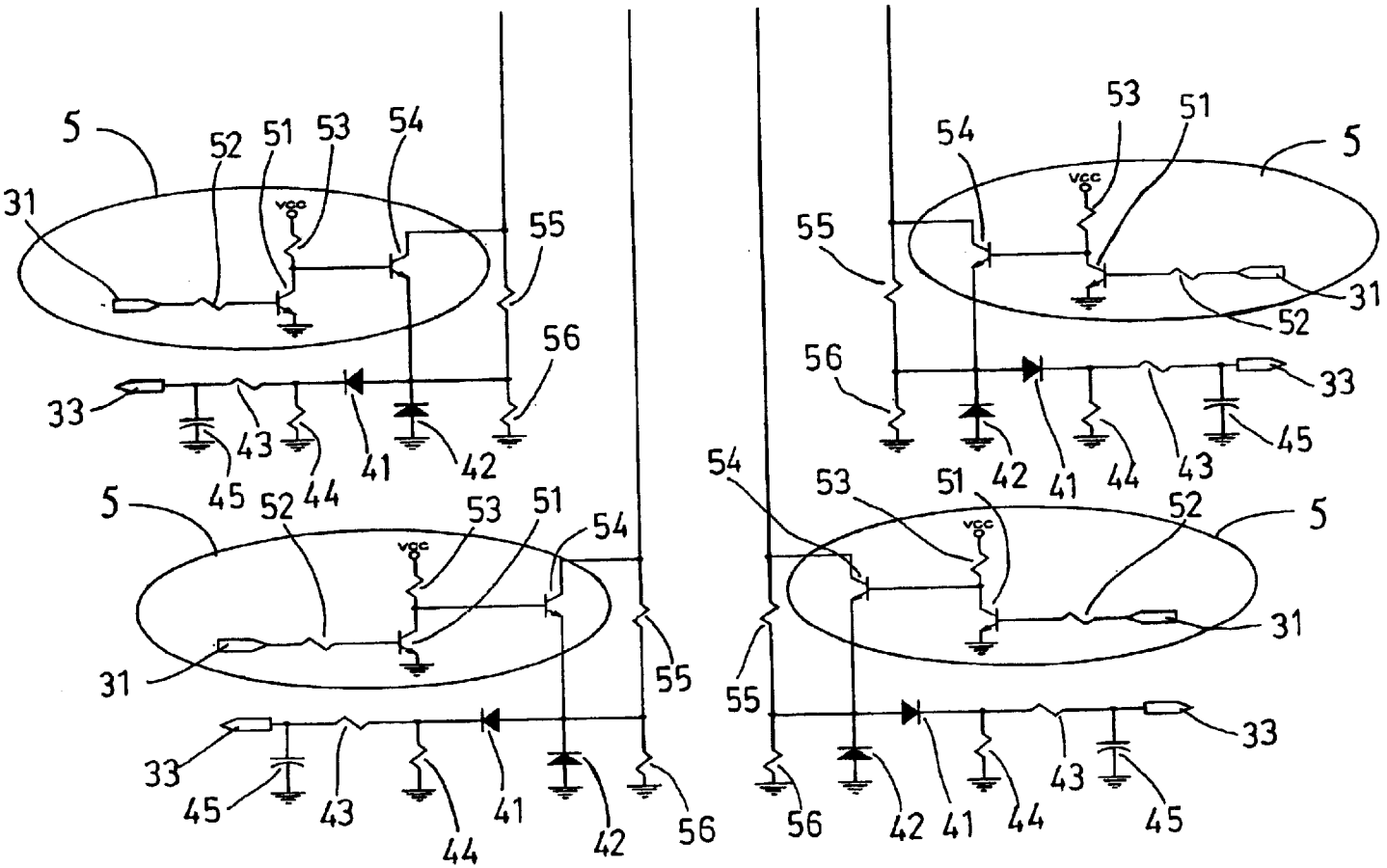
FIG. 4 is a partial plan schematic view illustrating the regulating or switching of the electric circuit of the lamp actuating facility.

As shown in FIG. 4, when one of the lamps 10 is to be actuated or energized, the output or actuating terminal 31 of the low frequency control unit 3 may output an actuating signal to actuate the transistor 51, and then to actuate the other transistor 54, and then to allow the electric current Ib1 of the lamp 10 (FIG. 5) to flow from the other transistor 54 to the ground via the resistor 56.

At this moment, the emitter of the other transistor 54 may have an actuating voltage generated via the resistor 56, and rectified by the diodes 41, 42 and the resistor 44 of the current detecting unit 4, and then evenly distributed by the integrator formed by the resistor 43 (FIGS. 2, 4, 5) and the capacitor 12 (FIGS. 2, 5), and then transmitted into the input terminals 33 of the low frequency control unit 3, in order to be compared with the predetermined average value of the effective current.

When the actuating voltage or current has reached the predetermined average value of the effective current, the low frequency control unit 3 may output a stop voltage or signal via the output or actuating terminal 31 thereof, in order to stop or to switch off the transistors 51, 54, and to have the electric current Ib1 of the lamp 10 (FIG. 5) to flow to the ground via the resistors 55, 56. At this moment, a stop voltage or signal may be generated by the resistors 55, 56 to prevent the electric current to flow from the current detecting units 4 to the low frequency control unit 3.

Similarly, the electric currents Ib2, Ib3, Ib4 that are required to flow through the other lamps 10 (FIG. 5) may also be obtained or reached to the predetermined average value of the effective current via the transistors 51, 54 of the regulating devices 5 and the current detecting units 4. When the electric currents Ib2, Ib3, Ib4 flowing through every lamp 10 reaches the predetermined average value of the effective current, the lamps 10 may be suitably or normally energized. The power of the MOSFET 34 may then be adjusted or regulated to have the transformer 21 of the inverter circuit 2 reaches the predetermined average value of the effective current.

The characteristics of the lamps may be changed or different from lamps to lamps, due to different manufacturing processes, over aged, etc., such that the electricity or the value of the electric current flowing through the lamps 10 may be different from each other.

Figure 5:
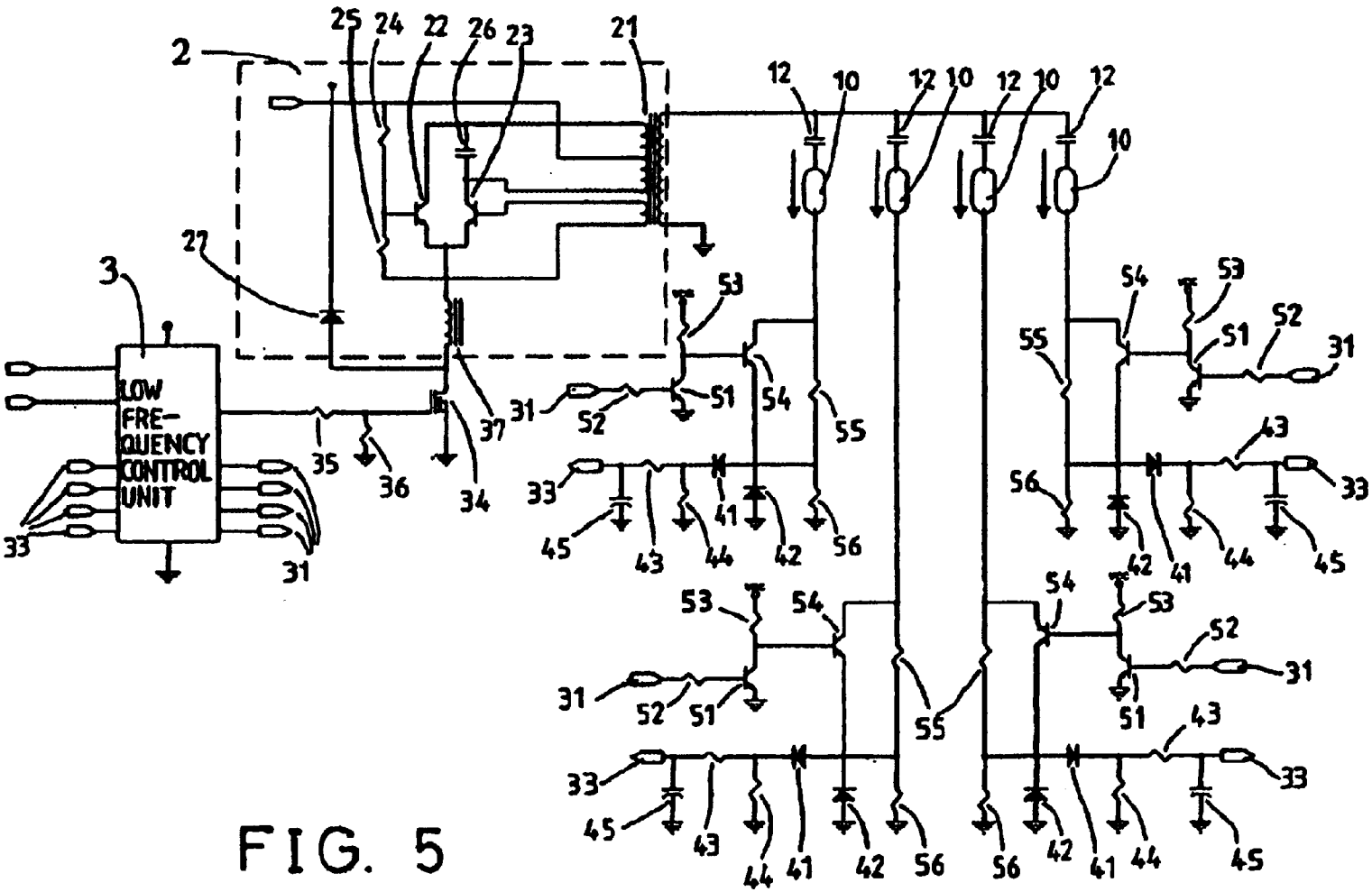
FIG. 5 is a partial plan schematic view illustrating the even control of the lamp current through the electric circuit of the lamp actuating facility.

As shown in FIG. 5, by separately controlling the actuating time of the transistors 54 for the respective lamps 10, the electric currents Ib1, Ib2, Ib3, Ib4 flowing through the respective lamps 10 may be obtained and maintained at the predetermined average value of the effective current, such that the lamps 10 may be maintained at the same or identical brightness, and the electric current flowing through the respective lamps 10 may be suitably balanced or controlled.

The output or actuating terminals 31 of the low frequency control unit 3 are preferably output or controlled by the so-called deployed phase control method, in order to cyclically actuate the lamps 10, and to prevent the generation of the electromagnetic interference, and also to decrease the consumption of the electric power, and to evenly deploy the power consuming of the lamps 10.

It is to be noted that, whenever output signals are output or stopped via the output or actuating terminals 31 of the low frequency control unit 3, the resistor 56 may maintain the lamps 10 at an initializing status. The other resistor 55 may provide a normal actuating status to continuously output the high frequency initializing status, and to control and maintain every lamp 10 at the predetermined average value of the effective current, and thus for allowing the lamps 10 to be effectively and alternatively actuated.

Figure 6:
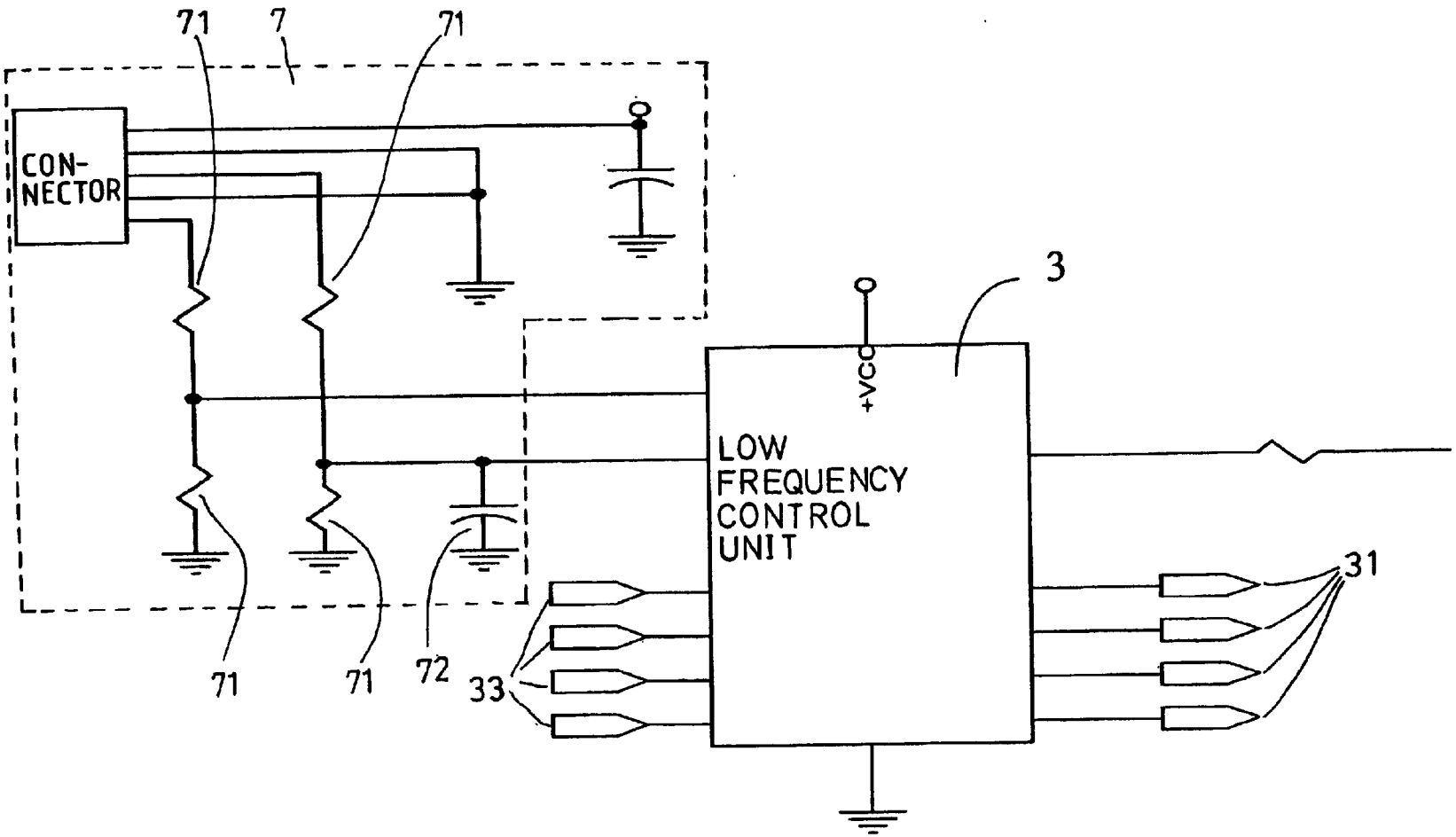
FIG. 6 is a partial plan schematic view illustrating the control of the brightness of the electric circuit of the lamp actuating facility.

Referring next to FIG. 6, a filtering circuit 7 may further be provided and may include four resistors 71, a capacitor 72 coupled to the low frequency control unit 3, for filtering purposes, and for adjusting the brightness of the lamps 10.

Accordingly, the lamp actuating facility in accordance with the present invention may be provided or used for evenly or uniformly driving or actuating a number of light tubes or lamps of such as liquid crystal display (LCD) light devices or display panels.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

What is claimed is:

1. A lamp actuating facility comprising:

a plurality of lamps each including an output terminal, an inverter circuit coupled to said lamps, to convert electric power and to energize said lamps, a low frequency control unit coupled to said inverter circuit, to set an average current value at said output terminals of said lamps, and to control said inverter circuit, a plurality of current detecting units coupled between said lamps and said low frequency control unit respectively, to obtain the average current value at said output terminals of said lamps, and to send the average current value back to said low frequency control unit, and a plurality of regulating devices coupled between said lamps and said low frequency control unit respectively, to control electric power through said lamps, and to maintain each of said lamps at the average current value, each of said regulating devices including a first transistor having a base coupled to said low frequency control unit, a collector coupled to electric power source, and an emitter grounded, and each of said regulating devices further including a first resistor having two ends, a second resistor, a second transistor having a base coupled to said collector of said first transistor, and having a collector and an emitter coupled to said ends of said first resistor, and then grounded via said second resistor.

2. The lamp actuating facility as claimed in claim 1 further comprising a MOSFET coupled between said inverter circuit and said low frequency control unit.

3. The lamp actuating facility as claimed in claim 2, wherein said MOSFET includes a drain electrode coupled to said inverter circuit via an inductor, a gate electrode connected to said low frequency control unit, and a source electrode grounded.

4. The lamp actuating facility as claimed in claim 1, wherein said first resistor includes a resistance greater than that of said second resistor.

5. The lamp actuating facility as claimed in claim 1, wherein each of said current detecting units includes an integrator coupled to said low frequency control unit.

* * * * *